US006333478B1

(12) United States Patent
Altmann

(10) Patent No.: US 6,333,478 B1
(45) Date of Patent: Dec. 25, 2001

(54) DIAPHRAGM SWITCH

(75) Inventor: Markus Altmann, Bankholzen (DE)

(73) Assignee: TRW Automoitve Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 09/761,913

(22) Filed: Jan. 17, 2001

(30) Foreign Application Priority Data

Jan. 21, 2000 (DE) ..... 200 01 024

(51) Int. Cl.[7] ..... H01H 13/14

(52) U.S. Cl. ..... 200/520; 200/517; 200/314; 200/341; 200/345

(58) Field of Search ..... 200/517, 520, 200/213, 302.1, 302.2, 310, 313, 314, 317, 341, 345

(56) References Cited

U.S. PATENT DOCUMENTS 4,251,723 * 2/1981 Speidel et al. ..... 250/229
5,727,675 * 3/1998 Leveque et al. ..... 200/524
5,803,240 9/1998 Swidersky et al. ..... 200/344
6,091,066 * 7/2000 Sugihara ..... 250/229
6,096,989 * 8/2000 Kinoshita ..... 200/345

FOREIGN PATENT DOCUMENTS 9403910 6/1994 (DE) ..... H01H/13/14
4316998 11/1994 (DE) ..... H01H/13/14

* cited by examiner

*Primary Examiner*—Michael Friedhofer
(74) *Attorney, Agent, or Firm*—Tarolli, Sundheim, Covell, Tummino & Szabo L.L.P.

(57) ABSTRACT

A diaphragm touchbutton switch having a housing and a touchbutton slidingly guided on the housing. The housing comprises an outer wall that extends to a base surface area facing away from the touchbutton. The outer wall is bent inwards at the base surface area and passes into an inner wall angled parallel to the outer wall. The inner wall forms a connector chamber, and the touchbutton comprises at least one integrally molded guiding wall, engaged between the inner wall and the outer wall of the housing.

6 Claims, 2 Drawing Sheets

DIAPHRAGM SWITCH

FIELD OF THE INVENTION

The invention relates to a diaphragm touchbutton switch having a housing and a touchbutton slidingly guided on the housing.

BACKGROUND OF THE INVENTION

Modern diaphragm touchbutton switches as used, more particularly, in motor vehicles, have a short stroke and feature, where required, a lighted icon. They comprise a plastics housing and a touchbutton mounted and guided therein. Located below the touchbutton is a connector chamber into which a generally multi-pin connector is inserted to latch in place. The connector chamber takes up most of the depth of the switch overall as generally predefined so that little depth remains for guiding the touchbutton.

BRIEF SUMMARY OF THE INVENTION

The invention provides a diaphragm touchbutton switch having a housing and a touchbutton slidingly guided on the housing. The housing comprises an outer wall that extends to a base surface area facing away from the touchbutton. The outer wall is bent inwards at the base surface area and passes into an inner wall angled parallel to the outer wall. The inner wall forms a connector chamber, and the touchbutton comprises at least one integrally molded guiding wall, engaged between the inner wall and the outer wall of the housing.

The guiding wall of the touchbutton thus surrounds the connector chamber so that the depth of the connector chamber poses no restriction to the touchbutton guide length. In the preferred embodiment the guiding wall of the touchbutton thus extends close to the base surface area of the housing.

A further improvement in guiding the touchbutton is achieved in the preferred embodiment in that guide keys and cooperating guide channels are integrally molded on the inside of the outer wall of the housing and on the outside of the guiding wall of the touchbutton.

Furthermore, in the preferred embodiment the inner wall of the housing has an end facing the touchbutton connected to a top that extends at a right angle to said inner wall. Between the touchbutton and the top wall a circuit board may be disposed which carries functional elements of the diaphragm touchbutton switch including a diaphragm switching element for touchbutton actuation and an optional lighted icon.

BRIEF DESCRIPTION OF THE DRAWINGS

Further advantages and features of the invention become apparent from the following description and from the accompanying drawings to which reference is made, in which.

DETAILED DESCRIPTION OF THE INVENTION

Figure 1:
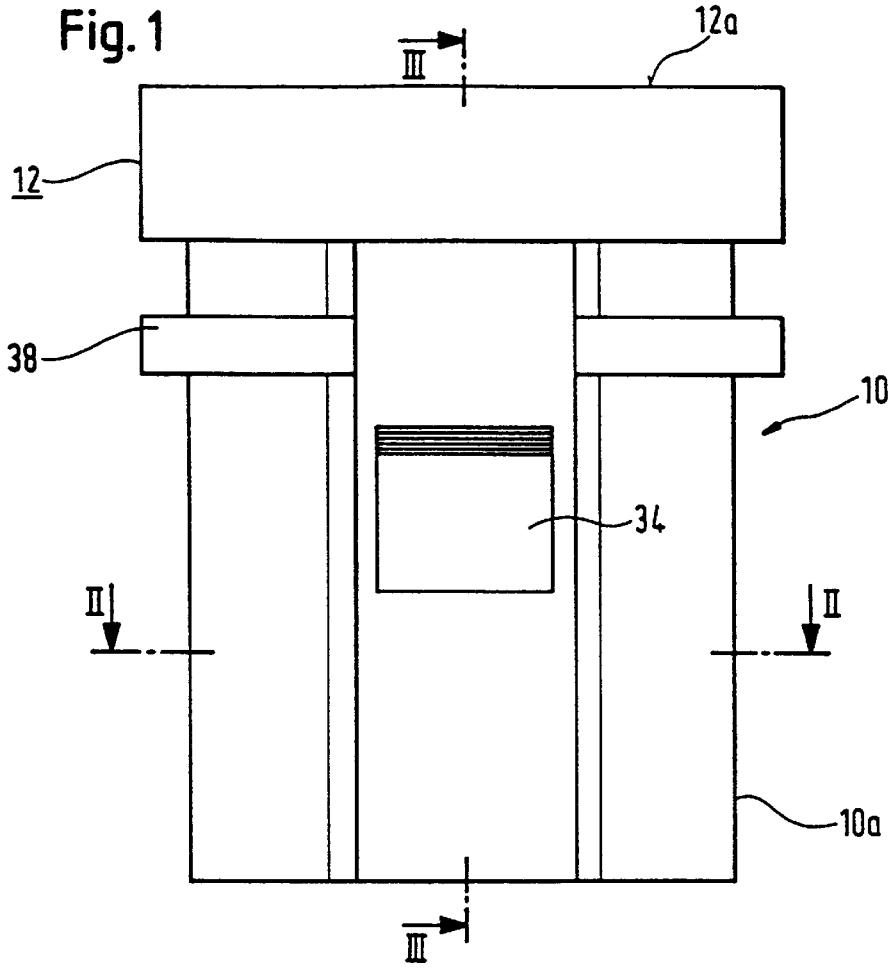
FIG. 1 is a schematic side view of the diaphragm touchbutton switch.

Referring now to FIG. 1 there is illustrated the diaphragm touchbutton switch comprising a housing 10 of a plastics material, shaped generally cylindrical and cross-sectionally corresponding to a rectangle having rounded edges. Arranged on the housing 10 is a touchbutton 12, likewise of a plastics material. The touchbutton 12 includes a touch surface 12*a* and an integrally molded guidewall 12*b*.

Figure 3:
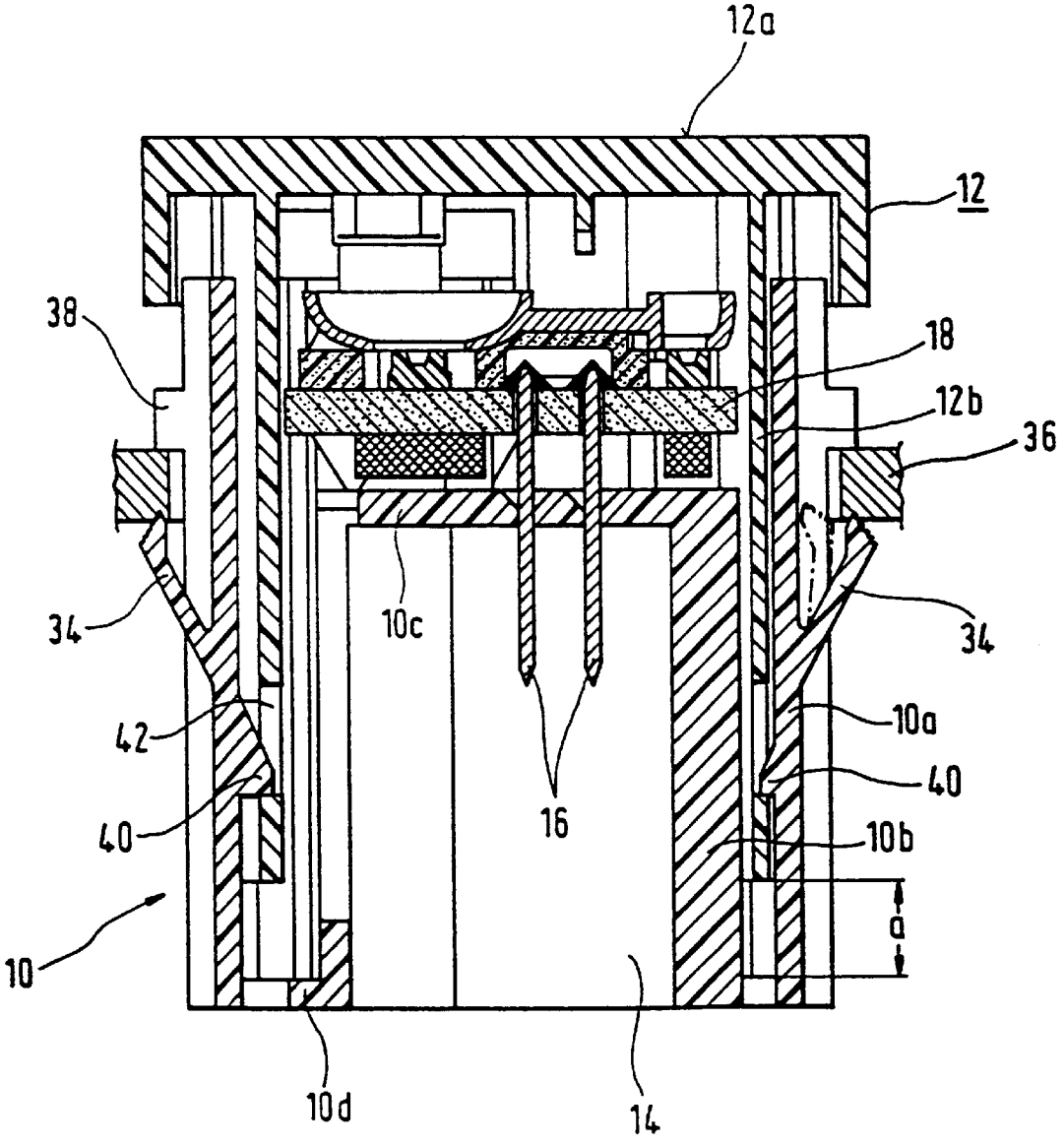
FIG. 3 is a section taken along the line III—III as shown in FIG. 1.

Referring now to FIG. 3 there is illustrated the housing 10 comprising an outer wall 10*a* extending between an upper edge facing the touchbutton 12 and a base surface area where it is bent inwards, an inner wall 10*b* originating from the inwardly bent portion of the outer wall 10*a* and extending parallel to the outer wall in the direction of the touchbutton 12, and a top wall 10*c* parallel to the touch surface 12*a*. All components of the housing 10, outer wall 10*a*, inner wall 10*b* and top wall 10*c* are integrally molded, more particularly injection molded, with each other. The inner wall 10*b* of the housing defines by the top wall 10*c* a connector chamber 14 into which the contact pins 16 protrude. The contact pins 16 penetrate the top wall 10*c* and are connected to a circuit board 18 disposed between the touchbutton 12 and the top wall 10*c* of the housing parallel thereto. Mounted on the circuit board 18 are various functional elements of the diaphragm touchbutton switch, these including switch contacts, LEDs, electronic components and the like. Located between the touchbutton 12 and the circuit board 18 are optical and mechanical communicating elements.

The outer wall 10*a* and inner wall lob of the housing 10 are radially spaced away from each other. Inserted into the interspace thus formed between the outer wall 10*a* and the inner wall 10*b* is the guidewall 12*b* of the touchbutton 12. This guidewall 12*b* extends between the outer wall 10*a* and inner wall 10*b* down to the vicinity of the base surface area 10*d* of the housing 10 where inner wall and outer wall join. The distance a between the end of the guidewall 12*b* and the base surface area of the housing 10 is somewhat larger than the stroke provided for the touchbutton.

Figure 2:
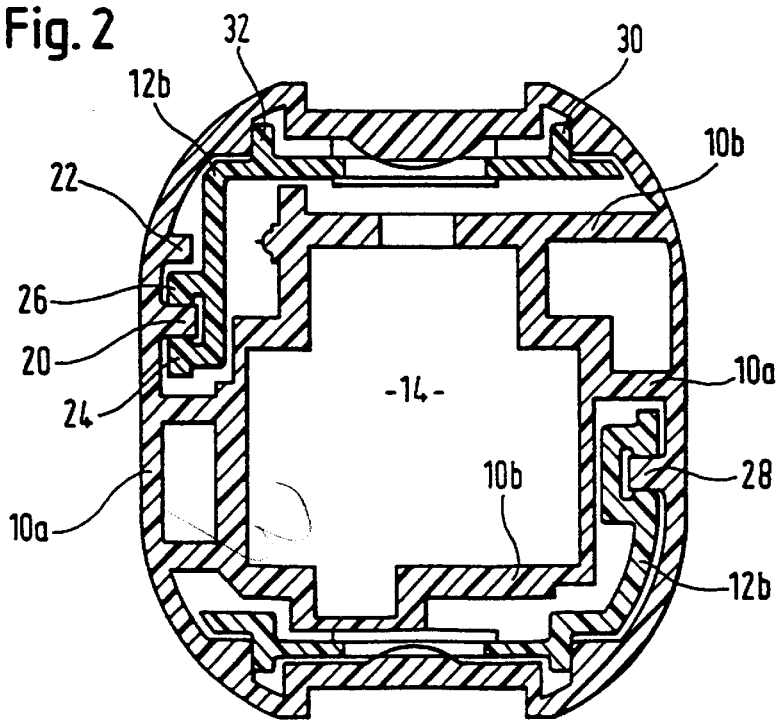
FIG. 2 is a section taken along the line II—II as shown in FIG. 1.

Referring now to FIG. 2 there are illustrated configured on the inside of the outer wall 10*a* and at the outside of the guidewall 12*b* interengaging guiding structures in the form of keys and channels. Thus, molded on the inside of the outer wall 10*a* is a key 20 engaging between two adjacent keys 24, 26 molded to the outside of the guidewall 12*b* of the touchbutton 12. Located roughly diagonally opposite thereto at 28 as evident from FIG. 2 is a similar guiding structure including a molded key 28 on the inside of the outer wall 10*a* engaging a channel on the outside of the guidewall 12*b*. Further keys 30, 32 are molded on the outside of the guidewall 12*b* and extend perpendicular to the key 20 and key 28 so that the touchbutton 12 is supported in two directions perpendicular to each other and perpendicular to the their centerline practically with zero clearance. Furthermore, a key 22 is molded on the inside of the outer wall 10*a* and serves to polarize assembly of the touchbutton 12.

Molded furthermore to the outside of the outer wall 10*a* of the housing 10 are latching arms 34 by means of which the diaphragm touchbutton switch is latched in place in an opening of a filler 36 or the like. Molded axially spaced away from and opposite to the free ends of the latching arms 34 is a peripheral contact collar 38 at the outside of the outer wall 10*a*, this contact collar 38 defining the axial position of the housing 10 relative to the filler 36.

On the inside of the outer wall 10*a* latching detents 40 are molded to engage corresponding recesses 42 in the guidewall 12*b* of the touchbutton 12 to latch the touchbutton in place at the housing 10 with the clearance as needed for the stroke of the touchbutton.

What is claimed is:

1. A diaphragm touchbutton switch having a housing and a touchbutton slidingly guided on said housing, said housing comprising an outer wall extending to a base surface area facing away from said touchbutton, the outer wall being bent inwards at said base surface area and passing into an inner wall angled parallel to said outer wall, said inner wall forming a connector chamber, and said touchbutton comprising at least one integrally molded guiding wall engaged between said inner wall and said outer wall of said housing.

2. The diaphragm touchbutton switch as set forth in claim 1, wherein said guiding wall of said touchbutton extends close to said base surface area.

3. The diaphragm touchbutton switch as set forth in claim 2, wherein guide keys and cooperating guide channels are integrally molded on the inside of said outer wall of said housing and on the outside of said guiding wall of said touchbutton.

4. The diaphragm touchbutton switch as set forth in claim 1, wherein said inner wall of said housing has an end facing said touchbutton connected to a top wall that extends at a right angle to said inner wall.

5. The diaphragm touchbutton switch as set forth in claim 4, wherein a circuit board is disposed between said touchbutton and said top wall, said circuit board carrying functional elements of said diaphragm touchbutton switch including a diaphragm switching element for touchbutton actuation and an optional lighted icon.

6. The diaphragm touchbutton switch as set forth in claim 5, wherein contact pins protrude into said connector chamber from said circuit board passing through said top wall.

* * * * *

UNITED STATES PATENT AND TRADEMARK OFFICE

CERTIFICATE OF CORRECTION

PATENT NO. : 6,333,478 B1
DATED : December 25, 2001
INVENTOR(S) : Markus Altmann It is certified that error appears in the above-identified patent and that said Letters Patent is hereby corrected as shown below:

Title page,
Item [73], Assignee, replace "Automoitve" to -- Automotive --.

Signed and Sealed this

Fourth Day of February, 2003

JAMES E. ROGAN
*Director of the United States Patent and Trademark Office*